US011708966B2

(12) United States Patent
Shohat et al.

(10) Patent No.: US 11,708,966 B2
(45) Date of Patent: Jul. 25, 2023

(54) STRIP LIGHTING SYSTEM FOR DIRECT INPUT OF HIGH VOLTAGE DRIVING POWER

(71) Applicant: Korrus, Inc., Los Angeles, CA (US)

(72) Inventors: Ariel Shohat, Modin (IL); Ariel Meir, Aventura, FL (US)

(73) Assignee: KORRUS, INC., Los Angeles, CA (US)

( * ) Notice: Subject to any disclaimer, the term of this patent is extended or adjusted under 35 U.S.C. 154(b) by 0 days.

(21) Appl. No.: 17/659,260

(22) Filed: Apr. 14, 2022

(65) Prior Publication Data

US 2022/0373167 A1 Nov. 24, 2022

Related U.S. Application Data

(63) Continuation of application No. 16/717,883, filed on Dec. 17, 2019, now Pat. No. 11,353,200.

(60) Provisional application No. 62/915,604, filed on Oct. 15, 2019, provisional application No. 62/780,545, filed on Dec. 17, 2018.

(51) Int. Cl.

| | |
|---|---|
| ***F21V 23/00*** | (2015.01) |
| ***F21S 4/28*** | (2016.01) |
| ***F21Y 115/10*** | (2016.01) |
| ***F21Y 103/10*** | (2016.01) |

(52) U.S. Cl.

CPC ..... *F21V 23/001* (2013.01); *F21S 4/28* (2016.01); *F21Y 2103/10* (2016.08); *F21Y 2115/10* (2016.08)

(58) Field of Classification Search

CPC ..... F21V 23/001; F21V 23/002; F21S 4/28

See application file for complete search history.

(56) References Cited

U.S. PATENT DOCUMENTS

| | | | |
|---|---|---|---|
| 3,262,250 | A | 7/1966 | Fowler |
| 3,434,897 | A | 3/1969 | Caretta |
| 4,445,164 | A | 4/1984 | Giles, III |
| 4,580,859 | A | 4/1986 | Frano |
| 4,603,496 | A | 8/1986 | Latz |
| 4,727,648 | A | 3/1988 | Savage, Jr. |
| 4,837,927 | A | 6/1989 | Savage, Jr. |
| 5,087,212 | A | 2/1992 | Hanami |
| 5,174,649 | A | 12/1992 | Alston |
| 5,241,457 | A | 8/1993 | Sasajima |
| 5,387,901 | A | 2/1995 | Hardt |
| 5,436,809 | A | 7/1995 | Brassier |
| 5,450,664 | A | 9/1995 | Babow |
| 5,490,048 | A | 2/1996 | Brassier |

(Continued)

FOREIGN PATENT DOCUMENTS

| | | |
|---|---|---|
| CA | 2623604 | 8/2009 |
| CN | 101592291 A | 12/2009 |

(Continued)

OTHER PUBLICATIONS

International Patent Application No. PCT/US2018/015449; Int'l Preliminary Report on Patentability; dated Aug. 8, 2019; 8 pages.

(Continued)

*Primary Examiner* — Alexander K Garlen

(74) *Attorney, Agent, or Firm* — Jay M. Brown

(57) ABSTRACT

Strip lighting systems that include a series of LEDs and which comply with AC driving power.

16 Claims, 3 Drawing Sheets

(56) References Cited

U.S. PATENT DOCUMENTS 5,628,557 A 5/1997 Huang
5,632,551 A 5/1997 Roney
5,658,066 A 8/1997 Hirsch
5,821,695 A 10/1998 Vilanilam
6,283,612 B1 9/2001 Hunter
6,354,714 B1 3/2002 Rhodes
6,426,704 B1 7/2002 Hutchison
6,439,743 B1 8/2002 Hutchison
6,450,662 B1 9/2002 Hutchison
6,450,664 B1 9/2002 Kelly
6,473,002 B1 10/2002 Hutchison
6,474,839 B1 11/2002 Hutchison
6,481,130 B1 11/2002 Wu
6,527,422 B1 3/2003 Hutchison
6,530,674 B2 3/2003 Grierson
6,582,103 B1 6/2003 Popovich
6,590,235 B2 7/2003 Carey
6,601,970 B2 8/2003 Ueda
6,676,284 B1 1/2004 Wynne Willson
6,773,138 B2 8/2004 Coushaine
6,824,296 B2 11/2004 Souza
6,827,469 B2 12/2004 Coushaine
6,851,832 B2 2/2005 Tieszen
6,880,952 B2 4/2005 Kiraly
6,882,111 B2 4/2005 Kan
6,893,144 B2 5/2005 Fan
6,979,097 B2 12/2005 Elam
7,093,958 B2 8/2006 Coushaine
7,111,964 B2 9/2006 Suehiro
7,112,926 B2 9/2006 Himori
7,132,804 B2 11/2006 Lys
7,150,553 B2 12/2006 English
7,159,997 B2 1/2007 Reo
7,161,311 B2 1/2007 Mueller
7,210,957 B2 5/2007 Mrakovich
7,221,104 B2 5/2007 Lys
7,229,192 B2 6/2007 Mayfield, III
7,261,435 B2 8/2007 Gould
7,267,461 B2 9/2007 Kan
7,360,925 B2 4/2008 Coushaine
7,414,269 B2 8/2008 Grotsch
7,455,422 B2 11/2008 Gould
7,456,499 B2 11/2008 Loh
7,481,552 B2 1/2009 Mayfield, III
7,481,566 B2 1/2009 Han
7,530,716 B2 5/2009 Mayfield, III
7,540,761 B2 6/2009 Weber
7,549,786 B2 6/2009 Higley
7,575,332 B2 8/2009 Cok
7,595,113 B2 9/2009 Miyoshi
7,604,365 B2 10/2009 Chang
7,654,703 B2 2/2010 Kan
7,700,965 B2 4/2010 Chang
7,703,951 B2 4/2010 Piepgras
7,712,926 B2 5/2010 Matheson
7,727,009 B2 6/2010 Goto
7,731,396 B2 6/2010 Fay
7,744,266 B2 6/2010 Higley
7,766,518 B2 8/2010 Piepgras
7,806,562 B2 10/2010 Behr
7,810,955 B2 10/2010 Stimac
7,810,995 B2 10/2010 Fadler
7,841,753 B2 11/2010 Liu
7,857,482 B2 12/2010 Reo
7,866,847 B2 1/2011 Zheng
7,878,683 B2 2/2011 Logan
7,918,589 B2 4/2011 Mayfield, III
7,922,364 B2 4/2011 Tessnow
7,923,907 B2 4/2011 Tessnow
7,952,114 B2 5/2011 Gingrich, III
7,961,113 B2 6/2011 Rabiner
7,972,038 B2 7/2011 Albright
7,988,336 B1 8/2011 Harbers
7,997,758 B2 8/2011 Zhang
8,033,680 B2 10/2011 Sharrah
8,052,310 B2 11/2011 Gingrinch, III
8,066,403 B2 11/2011 Sanfilippo
8,076,683 B2 12/2011 Xu
8,113,680 B2 2/2012 O'Brien
8,118,454 B2 2/2012 Rains, Jr.
8,154,864 B1 4/2012 Nearman
8,172,436 B2 5/2012 Coleman
8,207,546 B2 6/2012 Harada
8,256,930 B2 9/2012 Cheng
8,262,250 B2 9/2012 Li
8,272,758 B2 9/2012 Meir
8,297,788 B2 10/2012 Bishop
8,314,566 B2 11/2012 Steele
8,348,460 B2 1/2013 Bachl
8,371,723 B2 2/2013 Nall
8,434,897 B2 5/2013 Logan
8,434,898 B2 5/2013 Sanfilippo
8,449,128 B2 5/2013 Ko
8,454,193 B2 6/2013 Simon
8,525,190 B2 9/2013 Donofrio
8,545,045 B2 10/2013 Tress
8,552,456 B1 10/2013 Sun
8,575,646 B1 11/2013 Shum
8,598,778 B2 12/2013 Allen
8,616,720 B2 12/2013 Carney
8,676,284 B2 3/2014 He
8,690,368 B1 4/2014 Shipman
8,697,458 B2 4/2014 Nolan
8,702,265 B2 4/2014 May
8,748,202 B2 6/2014 Kwon
8,755,665 B2 6/2014 Hong
8,764,220 B2 7/2014 Chan
8,791,485 B2 7/2014 Ohbayashi
8,820,964 B2 9/2014 Gould
8,858,607 B1 10/2014 Jones
8,876,322 B2 11/2014 Alexander
8,876,325 B2 11/2014 Lu
8,893,144 B2 11/2014 Haham
8,969,894 B2 3/2015 Lee
8,998,448 B2 4/2015 Chang
9,016,895 B2 4/2015 Handsaker
9,022,603 B1 5/2015 Moghal
9,052,075 B2 6/2015 Demuynck
9,091,422 B2 7/2015 Greenfield
9,157,622 B2 10/2015 Yanping
9,188,290 B2 11/2015 Lay
9,285,085 B2 3/2016 Carney
9,295,855 B2 3/2016 Jones
9,518,706 B2 12/2016 Chan
9,605,812 B2 3/2017 Van De Ven
9,651,227 B2 5/2017 Pickard
9,666,772 B2 5/2017 Ibbetson
9,722,158 B2 8/2017 Chan
9,874,333 B2 1/2018 Lay
9,976,710 B2 5/2018 Meir
9,995,444 B2 6/2018 Leichner
10,030,828 B2 7/2018 Meir
10,100,988 B2 10/2018 Rodgers
10,132,476 B2 11/2018 Meir
10,228,099 B2 3/2019 Meir
10,378,705 B2 8/2019 Meir
10,465,864 B2 11/2019 Leichner
10,584,860 B2 3/2020 Dungan
10,612,747 B2 4/2020 Rodgers
10,989,372 B2 4/2021 Meir
2002/0114155 A1 8/2002 Katogi
2002/0117692 A1 8/2002 Lin
2003/0058658 A1 3/2003 Lee
2003/0072156 A1 4/2003 Pohlert
2003/0198049 A1 10/2003 Hulse
2003/0223235 A1 12/2003 Mohacsi
2004/0052076 A1 3/2004 Mueller
2004/0070855 A1 4/2004 Benitez
2004/0105261 A1 6/2004 Ducharme
2004/0218386 A1 11/2004 Doll
2005/0092517 A1 5/2005 Fan
2005/0221518 A1 10/2005 Andrews
2005/0225985 A1 10/2005 Catalano
2005/0280016 A1 12/2005 Mok

(56) References Cited

U.S. PATENT DOCUMENTS

2005/0286265 A1 12/2005 Zampini
2006/0077687 A1 4/2006 Higashiyama
2006/0134440 A1 6/2006 Crivello
2006/0141851 A1 6/2006 Matsui
2006/0146531 A1 7/2006 Reo
2006/0181903 A1 8/2006 Okuwaki
2006/0187653 A1 8/2006 Olsson
2007/0058377 A1 3/2007 Zampini
2007/0064428 A1 3/2007 Beauchamp
2007/0092736 A1 4/2007 Boardman
2007/0103902 A1 5/2007 Hsiao
2007/0205425 A1 9/2007 Harada
2007/0206375 A1 9/2007 Piepgras
2007/0235751 A1 10/2007 Radkov
2007/0279727 A1 12/2007 Gandhi
2008/0048200 A1 2/2008 Mueller
2008/0080196 A1 4/2008 Ruud
2008/0144322 A1 6/2008 Norfidathul
2008/0165530 A1 7/2008 Hendrikus
2008/0212319 A1 9/2008 Klipstein
2008/0239755 A1 10/2008 Parker
2008/0244944 A1 10/2008 Nall
2008/0266900 A1 10/2008 Harbers
2008/0267572 A1 10/2008 Sampsell
2008/0298058 A1 12/2008 Kan
2008/0315228 A1 12/2008 Krames
2009/0021936 A1 1/2009 Stimac
2009/0026913 A1 1/2009 Mrakovich
2009/0109539 A1 4/2009 Devos
2009/0126792 A1 5/2009 Gruhlke
2009/0167203 A1 7/2009 Dahlman
2009/0185389 A1 7/2009 Tessnow
2009/0195168 A1 8/2009 Greenfeld
2009/0225546 A1 9/2009 Pearson
2009/0272996 A1 11/2009 Chakraborty
2009/0310354 A1 12/2009 Zampini, II
2009/0321766 A1 12/2009 Chang
2010/0008090 A1 1/2010 Li
2010/0033948 A1 2/2010 Harbers
2010/0060157 A1 3/2010 Shi
2010/0060202 A1 3/2010 Melanson
2010/0072488 A1 3/2010 Bierhuizen
2010/0141557 A1 6/2010 Gruhlke
2010/0237766 A1 9/2010 Baumgartner
2010/0246179 A1 9/2010 Long
2010/0254134 A1 10/2010 Mccanless
2010/0308354 A1 12/2010 David
2011/0013387 A1 1/2011 Kanade
2011/0025951 A1 2/2011 Jones
2011/0051394 A1 3/2011 Bailey
2011/0051407 A1 3/2011 St Ives
2011/0051425 A1 3/2011 Tsuchiya
2011/0062470 A1 3/2011 Bierhuizen
2011/0089453 A1 4/2011 Min
2011/0122643 A1 5/2011 Spork
2011/0134634 A1 6/2011 Gingrich, III
2011/0136374 A1 6/2011 Mostoller
2011/0164426 A1 7/2011 Lee
2011/0193490 A1 8/2011 Kumar
2011/0198067 A1 8/2011 Hada
2011/0210364 A1 9/2011 Nolan
2011/0222270 A1 9/2011 Porciatti
2011/0255287 A1 10/2011 Li
2011/0280020 A1 11/2011 Chen
2011/0286222 A1 11/2011 Coleman
2011/0303935 A1 12/2011 Chern
2012/0002417 A1 1/2012 Li
2012/0025241 A1 2/2012 Xiao
2012/0025729 A1 2/2012 Melanson
2012/0051048 A1 3/2012 Smit
2012/0051056 A1 3/2012 Derks
2012/0051068 A1 3/2012 Pelton
2012/0087124 A1 4/2012 Ravillisetty
2012/0106152 A1 5/2012 Zheng
2012/0113676 A1 5/2012 Van Dijk
2012/0113678 A1 5/2012 Cornelissen
2012/0140474 A1 6/2012 Jurik
2012/0146066 A1 6/2012 Tischler
2012/0147621 A1 6/2012 Holten
2012/0170303 A1 7/2012 Meir
2012/0218750 A1 8/2012 Klase
2012/0250309 A1 10/2012 Handsaker
2012/0267650 A1 10/2012 Schubert
2012/0286304 A1 11/2012 Letoquin
2013/0021775 A1 1/2013 Veerasamy
2013/0021797 A1 1/2013 Kubo
2013/0021811 A1 1/2013 Goldwater
2013/0063939 A1 3/2013 Kondo
2013/0083524 A1 4/2013 Devorris
2013/0093980 A1 4/2013 Goto
2013/0134445 A1 5/2013 Tarsa
2013/0214691 A1 8/2013 Chen
2013/0249387 A1 9/2013 Hsin
2013/0265750 A1 10/2013 Pickard
2013/0272000 A1 10/2013 Pearson
2013/0274398 A1 10/2013 Shiobara
2013/0292709 A1 11/2013 Tong
2013/0313965 A1 11/2013 Chiang
2014/0001952 A1 1/2014 Harris
2014/0036500 A1 2/2014 Eggleton
2014/0043812 A1 2/2014 Moreau
2014/0168997 A1 6/2014 Lee
2014/0176016 A1 6/2014 Li
2014/0177262 A1 6/2014 Lai
2014/0268720 A1 9/2014 Dungan
2014/0268748 A1 9/2014 Lay
2014/0268810 A1 9/2014 Marquardt
2014/0334142 A1 11/2014 Levante
2014/0367633 A1 12/2014 Bibl
2015/0003105 A1 1/2015 Goto
2015/0034976 A1 2/2015 Kim
2015/0036387 A1 2/2015 Myers
2015/0041839 A1 2/2015 Sakai
2015/0062892 A1 3/2015 Krames
2015/0062965 A1 3/2015 Oh
2015/0117022 A1 4/2015 Meir
2015/0144918 A1 5/2015 Cho
2015/0145406 A1 5/2015 Li
2015/0241034 A1 8/2015 Dankelmann
2015/0252982 A1 9/2015 Demuynck
2015/0276170 A1 10/2015 Motoyanagi
2015/0283768 A1 10/2015 Marquardt
2015/0316219 A1 11/2015 Mallory
2015/0326767 A1 11/2015 Kim
2016/0003424 A1 1/2016 Wu
2016/0035944 A1 2/2016 Spanard
2016/0076741 A1 3/2016 Rong
2016/0076743 A1 3/2016 Deutsch
2016/0093780 A1 3/2016 Beppu
2016/0170120 A1 6/2016 Shani
2016/0195225 A1 7/2016 Carney
2016/0201861 A1 7/2016 Meir
2016/0230958 A1 8/2016 Pickard
2016/0327249 A1 11/2016 Pearson
2016/0327256 A1 11/2016 Hall
2017/0009957 A1 1/2017 Lim
2017/0038015 A1 2/2017 Lunz
2017/0137627 A1 5/2017 Szwarcman
2017/0219170 A1 8/2017 Petluri
2017/0250319 A1 8/2017 Yajima
2017/0256693 A1 9/2017 Yoshizawa
2017/0261186 A1 9/2017 Meir
2017/0261187 A1 9/2017 Meir
2017/0309795 A1 10/2017 Kim
2017/0311422 A1 10/2017 Arai
2017/0343167 A1 11/2017 Petluri
2018/0100959 A1 4/2018 Vasylyev
2018/0113244 A1 4/2018 Vasylyev
2018/0238501 A1 8/2018 Honda
2019/0203889 A1 7/2019 Petluri
2019/0212492 A1 7/2019 Meng
2019/0219251 A1 7/2019 Meir
2019/0267523 A1 8/2019 Min
2019/0338918 A1 11/2019 Ashraf

(56) References Cited

U.S. PATENT DOCUMENTS

| | | | |
|---|---|---|---|
| 2019/0383450 | A1 | 12/2019 | Meir |
| 2020/0096178 | A1 | 3/2020 | Aviram |
| 2020/0098732 | A1 | 3/2020 | Meir |
| 2020/0141546 | A1 | 5/2020 | Meir |
| 2020/0144468 | A1 | 5/2020 | Meir |
| 2020/0158299 | A1 | 5/2020 | Meir |
| 2020/0191370 | A1 | 6/2020 | Shohat |
| 2021/0338861 | A1 | 11/2021 | Harrison |
| 2021/0341134 | A1 | 11/2021 | May |
| 2022/0057049 | A1 | 2/2022 | Hikmet |

FOREIGN PATENT DOCUMENTS

| | | | |
|---|---|---|---|
| CN | 201590432 | U | 9/2010 |
| CN | 201739849 | U | 2/2011 |
| CN | 101997074 | A | 3/2011 |
| CN | 202040752 | U | 11/2011 |
| CN | 102269351 | A | 12/2011 |
| EP | 0592746 | B1 | 3/1997 |
| EP | 2256833 | B1 | 4/2013 |
| EP | 2474775 | B1 | 11/2013 |
| EP | 2484956 | B1 | 6/2014 |
| ES | 1211538 | U | 5/2018 |
| FR | 3058203 | A1 * | 5/2018 |
| GB | 2457016 | A | 8/2009 |
| JP | 2011508406 | T | 3/2011 |
| JP | 2011204495 | A | 10/2011 |
| JP | 2011204658 | A | 10/2011 |
| KR | 20070039683 | | 4/2007 |
| KR | 20090013704 | A | 2/2009 |
| KR | 100974942 | B1 | 8/2010 |
| KR | 20110106033 | | 9/2011 |
| KR | 20120050280 | | 5/2012 |
| WO | 0215281 | | 2/2002 |
| WO | 2013059298 | A1 | 4/2013 |
| WO | 2014099681 | A2 | 6/2014 |
| WO | 20140822621 | | 6/2014 |
| WO | 2014099681 | A3 | 12/2014 |
| WO | 2015066184 | A1 | 5/2015 |
| WO | 2018015449 | | 1/2018 |
| WO | 2018140727 | A1 | 8/2018 |
| WO | 2019193218 | A1 | 10/2019 |
| WO | 2019213299 | A1 | 11/2019 |
| WO | 2020131933 | A1 | 6/2020 |
| WO | 2021021234 | A1 | 2/2021 |

OTHER PUBLICATIONS

International Patent Application No. PCT/US2018/015449; Int'l Search Report and the Written Opinion; dated Jun. 14, 2018; 16 pages.

International Patent Application No. PCT/US2019/030252; Int'l Search Report and the Written Opinion; dated Oct. 4, 2019; 13 pages.

International Search Report and Written Opinion for Application No. PCT/US14/62905 dated Jan. 22, 2015, 10 pages.

International Search Report and Written Opinion dated Nov. 27, 2013 in PCT Application No. PCT/US2013/045708, 3 pages.

PCT /US2012/060588, "International Application Serial No. PCT/US2012/060588, International Preliminary Report on Patentability and Written Opinion dated May 1, 2014", Ecosense Lighting Inc. et al, 7 Pages.

PCT/US2012/060588, International Application Serial No. PCT/US2012/060588, International Search Report and Written Opinion dated Mar. 29, 2013, Ecosense Lighting Inc. et al, 10 pages.

PCT/US2013/075172, "International Application Serial No. PCT/US2013/075172, International Search Report and Written Opinion dated Sep. 26, 2014", Ecosense Lighting Inc., 16 Pages.

PCT/US2014/062905, International Preliminary Report on Patentability dated May 3, 2016 (7 pp).

PCT/US2014/062905, Written Opinion of the Int'l Searching Authority dated Jan. 22, 2015 (6 pp).

* cited by examiner

STRIP LIGHTING SYSTEM FOR DIRECT INPUT OF HIGH VOLTAGE DRIVING POWER

CROSS-REFERENCE TO RELATED APPLICATIONS

This application is a continuation of commonly-owned U.S. patent application Ser. No. 16/717,883 filed on Dec. 17, 2019 being entitled "Strip Lighting System for Direct Input of High Voltage Driving Power", which claims the benefit of commonly-owned U.S. Provisional Patent Application Ser. No. 62/780,545, filed Dec. 17, 2018 and claims the benefit of commonly-owned U.S. Provisional Patent Application Ser. No. 62/915,604, filed Oct. 15, 2019, the entireties of all of the foregoing applications hereby being incorporated herein by reference in their entireties.

FIELD

The invention relates generally to lighting and, more particularly, to strip lighting systems that include a series of LEDs and which comply with AC driving power.

BACKGROUND

Light emitting diodes (LEDs) are typically formed from a semiconductor material that is doped to create a p-n junction. The LEDs typically emit light in a narrow spectrum (e.g., a spectrum that is smaller 100 nanometers in size) that is dependent upon the bandgap energy of the semiconductor material that forms the p-n junction.

In some application, lighting systems may include one or more optical component that receives light emitted from an LED. For example, a lens is a type of optical component that may be used to receive light emitted from an LED and adjust one or more characteristics of the light.

SUMMARY

Strip lighting systems that include a series of LEDs and which comply with AC driving power are described herein.

In one aspect, a strip lighting system is provided. The system comprises a tray and a circuit board disposed in the tray. One or more light emitting diodes (LEDs) are mounted to the circuit board. One or more wires are electrically connected to the circuit board and disposed at least in part within the tray. The system further comprises an elastomer in contact with the tray and encapsulating at least part of the circuit board and the one or more wires. The system is configured to be driven directly or indirectly by an AC power source of at least 60 Volts.

In some embodiments, the system further comprises a connector component electrically connected to the one or more wires. At least a portion of the connector component may not be encapsulated by the elastomer, in some cases.

In some embodiments, the system further comprises one or more lenses disposed over the one or more LEDs.

In some embodiments, the elastomer comprises silicone material.

In some embodiments, the tray comprises a divider that separates the tray into an upper section and a lower section. The circuit board and the one or more LEDs may be disposed within the upper section of the tray. The divider may comprise a base upon which the circuit board is positioned. The one or more wires may be disposed at least in part within the lower section of the tray.

In some embodiments, the one or more wires and/or the connector extend through an inlet port in the tray. The inlet port may be formed in an upper section of the tray. The one or more wires passes from the upper section of the tray to lower section of the tray via one or more apertures formed in the divider.

In some embodiments, the system comprises more than one strip lighting segment joined together.

In some embodiments, the lighting system is directly driven by an AC power source. For example, the voltage source may be a wall power socket.

In some embodiments, the lighting system is indirectly driven by an AC power source. The lighting system may be directly driven an LED driver electrically connected to the AC power source. In some embodiments, the LED driver is configured to convert the AC power to DC power. For example, the LED driver may be a rectifier power supply unit or a high voltage switched mode power supply (SMPS) unit.

Other aspects, embodiments and features will become apparent from the following non-limiting detailed description when considered in conjunction with the accompanying drawings, which are schematic and which are not intended to be drawn to scale. In the figures, each identical or nearly identical component that is illustrated in various figures typically is represented by a single numeral. For purposes of clarity, not every component is labeled in every figure, nor is every component of each embodiment shown where illustration is not necessary to allow those of ordinary skill in the art to understand the invention. In cases where the present specification and a document incorporated by reference include conflicting disclosure, the present specification shall control.

DETAILED DESCRIPTION

Figure 1:
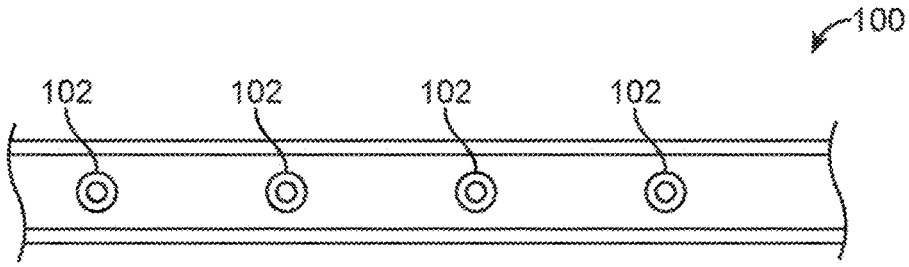
FIG. 1 shows a top view of a strip lighting system according to certain embodiments described herein.

Lighting systems are described herein. The lighting system may be implemented as a strip lighting system having a length (e.g., approximately six inches), a width that is less than the length (e.g., approximately one inch), and a height that is less than the width (e.g., approximately half an inch). As described further below, the lighting systems may be driven directly or indirectly by high voltage (e.g., 110 V, 220 V, etc.) alternating current (AC) power (e.g., supplied via a wall power socket). Embodiments of the lighting systems described herein may enable a number of advantages including the ability to connect the AC power source to the LED strip system on site, cutting and sealing the lighting strip for adjusting its length on site to fit the installation as well as the ability to use a long length strip by connecting several strip sections to one another, amongst other advantages. Moreover, the lighting systems may be designed to meet the requirements of UL 1598 standard as well as a polymeric enclosure structure that meets a UL94 5VA rating.

In some embodiments, the strip lighting system comprises a plurality of LEDs that are spaced along the length of the strip lighting systems (e.g., the LEDs may be spaced apart by approximately one inch). Strip lighting systems may have a construction similar to those described in U.S. Pat. Nos. 9,976,710 and 10,132,476 both of which are incorporated herein by reference in their entirety.

As described further below, the strip lighting system may comprise a tray, a circuit board disposed in the tray (e.g., disposed and/or mounted to a surface of the tray), an LED mounted to the circuit board, and an elastomer (e.g., silicone, rubber, etc.) encapsulating at least part of the circuit board and being in contact with the tray. One or more wires may run along at least a portion of the lighting strip (e.g., beneath the circuit board) and can electrically connect the circuit board(s) to an external power source. For example, at one end, the wires may be soldered to the circuit board and, at the opposite end, the wires may connect directly or indirectly to an AC power source. The AC power source may be a high voltage source of at least 60 Volts (e.g., 60 Volts-240 Volts), at least 110 Volts (e.g., 110 Volts-240 Volts) and the like. For example, the AC power source may provide standard household voltage such as 110 Volts, 115 Volts, 120 Volts, 220 Volts or 240 Volts. In embodiments which utilize direct connection, the wiring (and/or electrical connector which is connected to the wiring) may be directly connected to a wall port which supplies AC power. In embodiments which utilize indirect connection to an AC power source, the voltage source may be an LED driver power source (e.g., rectifier power supply unit, high voltage switched mode power supply (SMPS) unit) that converts the standard AC high voltage from the wall port to any high voltage output which may be either CV (constant voltage) or CC (constant current). In some of these embodiments, the LED driver power source may be a component external of the tray assembly; and, in other embodiments, the LED driver power source may be mounted on the PCB and encapsulated within the tray assembly. In other embodiments, the LED driver power source may be mounted within the tray and encapsulated within it.

In some embodiments, the strip lighting system may further comprise a lens assembly that is disposed above the LED and configured to change at least one characteristic of the light from the LED. The lens assembly may comprise at least one optical element such as a lens, a reflector, and/or a light scattering element. For example, the lens assembly may comprise only a lens. In another example, the lens assembly may comprise a lens and a reflector. The lens assembly may be attached to the strip lighting device via the circuit board (e.g., the lens assembly may be mounted to the circuit board) and/or the elastomer that at least partially encapsulates the circuit board (e.g., the elastomer may be in direct contact with at least part of the lens assembly).

As noted above, the lighting system may comprise an elastomer that at least partially encapsulates the circuit board. For example, the elastomer may be in contact with the circuit board and one or more components of the lens assembly such as the reflector. The elastomer may not be in contact with all of the components of the lens assembly. For example, the elastomer may not be in contact with the lens so as to provide a gap (e.g., an air gap) between the lens and the elastomer. The elastomer may protect the circuit board and/or electronic components mounted to the circuit board from the environment. Examples of suitable elastomers are described further below and include silicones and rubbers.

It should be appreciated that the embodiments described herein may be implemented in any of numerous ways. Examples of specific implementations are provided below for illustrative purposes only. It should be appreciated that these embodiments and the features/capabilities provided may be used individually, all together, or in any combination of two or more, as aspects of the technology described herein are not limited in this respect.

Figure 2:
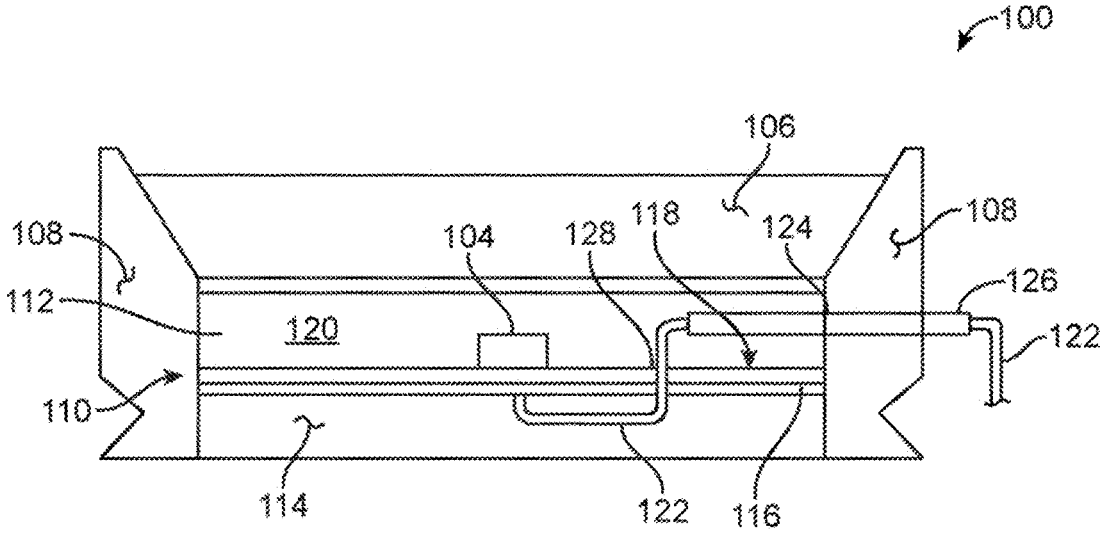
FIG. 2 shows a cross-section of a strip lighting system according to certain embodiments described herein.

FIGS. 1 and 2 show top and cross-section views, respectively, of a lighting system 100 according to some embodiments. As shown, the lighting system 100 is constructed as a strip lighting system. The strip lighting system includes a plurality of LED assemblies 102 which are arranged along the length of the system.

The LED assemblies 102 include at least one (and, in some cases, more) LED 104. In general, the LEDs used in the systems may have any suitable design. For example, the LED may be a semiconductor device that is configured to emit light. The light emitted from the LED may have an angular CCT deviation such as a phosphor converted LED. As described further below, the LEDs may be mounted on a circuit board (e.g., PCB).

As noted above, in some embodiments and as shown in FIG. 2, the lighting system may optionally comprise a plurality of lens assemblies 106 disposed over the LEDs. The lens assemblies may each comprise at least one optical element such as a lens, a reflect, and/or a scattering element. The lens assemblies may change at least one characteristic of the light emitted from the LEDs. For example, the LEDs may be phosphor converted LEDs that emit light with an angular CCT deviation. In this example, the lens assemblies may receive light from the LED and make the color temperature of the light more uniform. Additionally (or alternatively), the lens assembly may adjust a light distribution pattern of the LED. For example, the lens assembly may create a circular beam of light or an oblong beam of light. Example implementations of the lens assembly 106 are described in detail in U.S. Patent Publication No. 2017/0261186, titled "LIGHTING SYSTEM WITH LENS ASSEMBLY," published on Sep. 14, 2017, which is hereby incorporated herein by reference in its entirety.

It should be appreciated that the lens assemblies may be constructed from any of a variety of materials. For example, the lens assemblies may be constructed from one or more of the following materials: plastic (e.g., acrylic or polycarbonate), glass, and silicone. Further, the lens assemblies may be monolithic elements.

It should be appreciated that various alterations may be made to the lighting system 100 without departing from the scope of the present disclosure. For example, the lens assemblies 106 may be removed and, thereby, directly expose the LEDs under the lens assemblies 106. An example of such a lighting system without lens assemblies is described in U.S. Patent Publication No. 2016/0201861, titled "FLEXIBLE STRIP LIGHTING APPARATUS AND METHODS," published on Jul. 14, 2016, which is hereby incorporated herein by reference in its entirety.

As shown in FIG. 2, the lighting system comprises a tray 108 with a divider 110 that separates the tray into an upper section 112 and a lower section 114. The divider may comprise a base layer 116 upon which the circuit board 118 may be positioned. The base layer may be comprised of similar material (e.g., silicone) which forms side walls of the upper section.

The tray, for example, may have a minimum thickness of at least 2.5 mm and, in some areas, greater thicknesses. The upper section of the tray may have dimensions designed to accommodate optical components such as lens assemblies. The lower section of the tray may, for example, have a rectangular cross-section, though other cross-sectional shapes are possible.

The tray (e.g., upper and/or lower sections) may comprise a silicone material. In some embodiments, the tray is formed primarily (e.g., greater than 50% by weight, greater than 70% by weight, greater than 90% by weight) or essentially entirely of silicone. In some embodiments, the tray may consist essentially of a silicone material. For example, an extrusion process may be used to manufacture the tray according to certain embodiments.

A series of LEDs 104 are mounted on the circuit board in the upper section of the tray at regular intervals along the length of the system. As described above, the lens assemblies may be positioned above each LED. Potting (i.e., encapsulating) material 120 may be added to fill remaining space in the upper section of the tray. Thereby, the potting material 120 may be in contact with the circuit board, sections of the tray, the LEDs and/or lens assemblies as well as other components. Thereby, the circuit board may be at least partially encapsulated with an elastomer. The potting material and/or the tray may be constructed from an elastomer such as silicone material. For example, both the potting material and the tray may comprise silicone. It should be appreciated that the potting material may have a different material composition than the tray. In general, the tray and potting material are selected and configured to enable the lighting system to meet with the UL94 5VA test procedure.

Figure 3A:
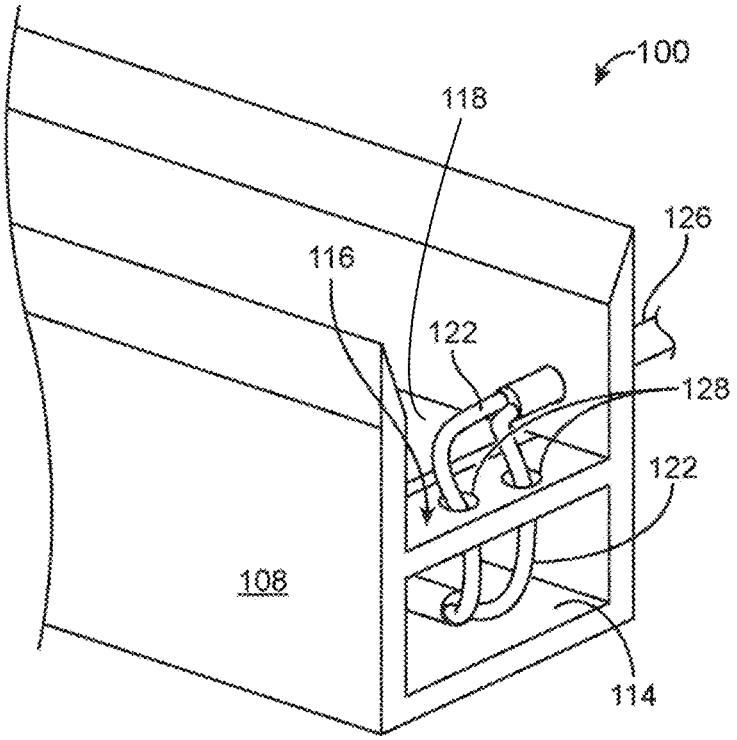
FIGS. 3A and 3B show wiring configurations used in connection with a strip lighting system according to certain embodiments described herein.
Figure 3B:
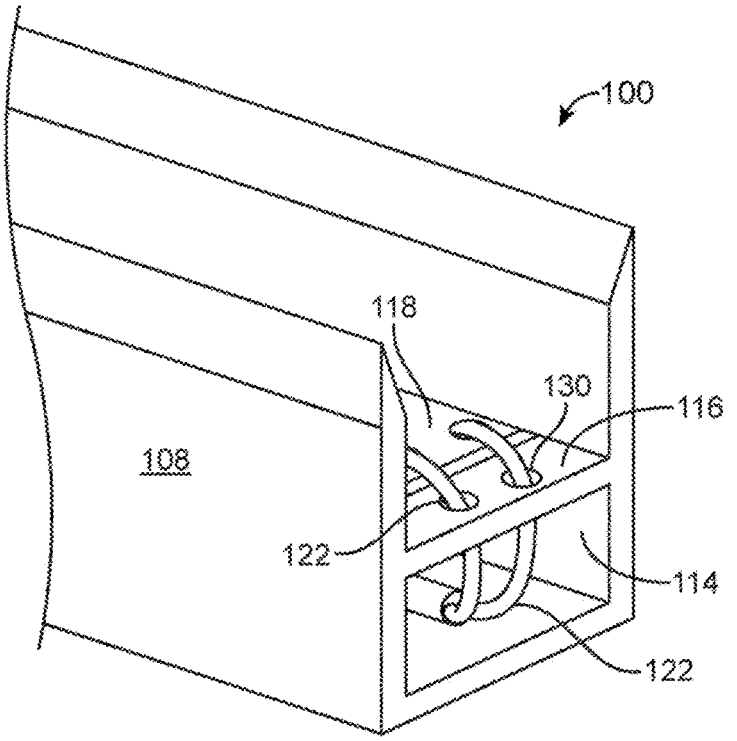

The lower section of the tray may house wiring 122 used to make electrical connections within the system. FIGS. 3A and 3B show wiring configurations that may be used according to certain embodiments. For example, the wiring may extend within the lower section of the tray beneath the circuit board along at least a portion of the length of the lighting strip. The wiring may supply power to the circuit board and, thus, the LEDs mounted on the circuit board. In some embodiments, multiple wires are utilized (e.g., ground wire, hot wire, etc.). In general, any type of wires that are suitable for use at the installation site may be used. The wiring may be connected to the circuit board. For example, wiring may be soldered to bond pads on the circuit board which are, in turn, electrically connected to the LEDs. During use, the wiring is electrically connected (directly or indirectly) to the AC power source. In some embodiments, the wiring may be connected to one or more electrical connector components. For example, the electrical components may facilitate connection of the wiring to the lighting system. Other embodiments may not utilize a separate electrical connector component.

Potting (i.e., encapsulating) material may be added to fill remaining space in the lower section of the tray. Thereby, the potting material may be in contact with the wiring, electrical connector(s) (if present) and sections of the tray. Thereby, the wiring may be at least partially encapsulated with an elastomer. The potting material and/or the tray may be constructed from an elastomer such as silicone material. For example, both the potting material and the tray may comprise silicone. It should be appreciated that the potting material may have a different material composition than the tray. In general, the tray and potting material are selected and configured to enable the lighting system to meet with the UL94 5VA test procedure.

In some embodiments, the wiring and/or electrical connector component enters the tray through an inlet port in the tray (e.g., See FIG. 3A). As shown in FIGS. 1B and 3A, inlet port 124 may be formed in a sidewall of the upper section of the tray. It should be understood that the inlet port may be formed in other areas of the tray including the lower section. In these illustrative embodiment, wiring is connected to an electrical connector component 126 which extends through the inlet port. In such embodiments, additional wiring connects to an opposite end of the electrical connector component and may extend directly or indirectly to the AC power source. Areas of the tray surrounding the inlet port may be re-enforced with metal to provide additional support.

In some embodiments, wiring passes from the upper section of the tray through apertures 128 formed in the divider to the lower section of the tray. Once in the lower section of the tray, the wiring may extend along (at least a portion of) the length of the lighting system and may pass through additional apertures 130 formed in the divider to return to the upper section of the tray where the wiring is connected (e.g., by soldering) to bond pad(s) on the circuit board (e.g., See FIG. 3B).

Figure 4A:
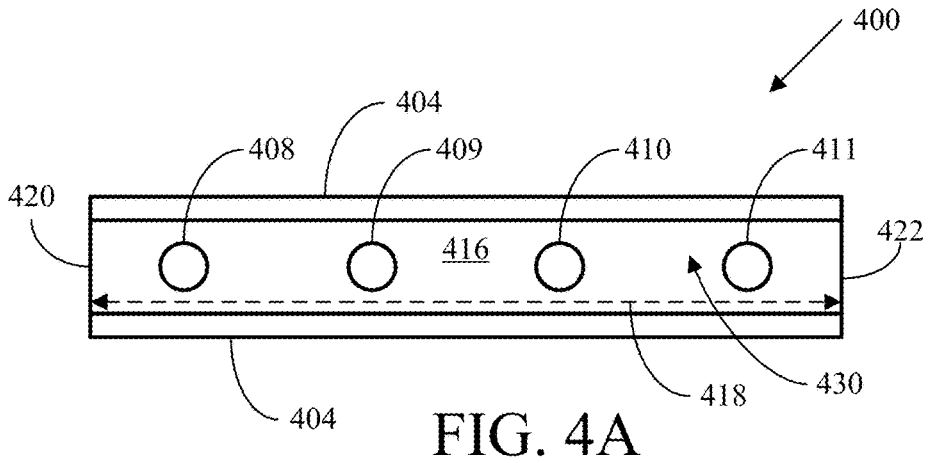
FIG. 4A shows a top view of another strip lighting system according to certain embodiments described herein.
Figure 4B:
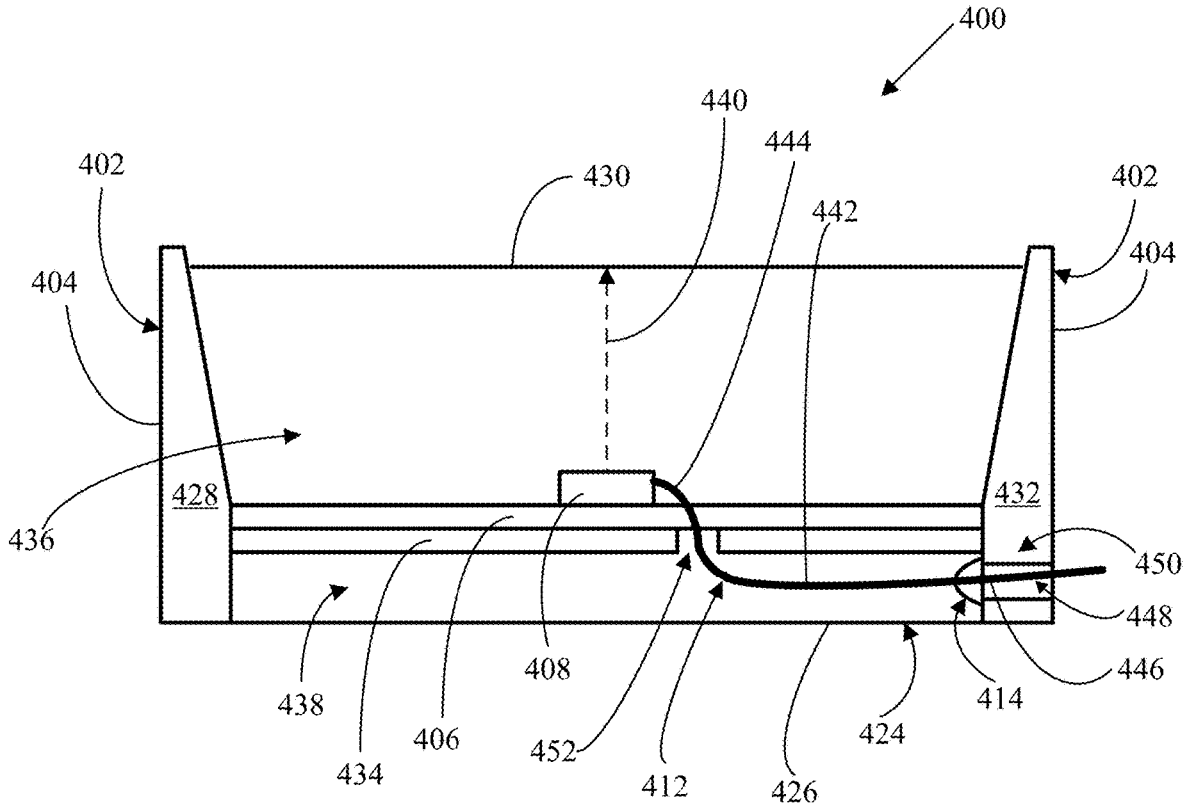
FIG. 4B shows a cross-section of the another strip lighting system according to certain embodiments described herein.

FIG. 4A shows a top view of another strip lighting system 400 according to certain embodiments described herein. FIG. 4B shows a cross-section of the another strip lighting system according to certain embodiments described herein. Referring to FIGS. 4A-4B, another example of a strip lighting system 400 is shown, including a tray 402 defining an elongated internal space 416, the tray 402 including a divider 434 separating the elongated internal space 416 into an upper section 436 and a lower section 438. The another example of a strip lighting system 400 also includes a circuit board 406 disposed in the upper section 436 of the elongated internal space 416, and one or more light emitting diodes (LEDs) 408, 409, 410, 411 mounted to the circuit board 406. Further, the another example of a strip lighting system 400 includes wiring 412 being electrically connected to the circuit board 406 and disposed at least in part within the upper section 436 and the lower section 438 of the elongated internal space 416. In the another example 400, the strip lighting system includes an external port 450 located in the lower section 438 of the elongated internal space 416, the wiring 412 passing into the strip lighting system 400 through the external port 450, the external port 450 being reinforced by an elastomeric strain-relief section 414. In the another example, the strip lighting system 400 is configured to be driven directly or indirectly by an alternating current (AC) power source. Further in the another example 400, the strip lighting system may include an elastomer in contact with the tray 402 in the upper section 436 of the elongated internal space 416 and encapsulating at least part of the circuit board 406 and at least part of the wiring 412. In some examples of the strip lighting system 400, the tray 402 may be formed by a wall 404 defining the elongated internal space 416 as spanning a distance 418 between two distal ends 420, 422 of the wall 404. Further in the another example 400 of the strip lighting system, the wall 404 may include a base 424 forming a bottom surface 426 of the strip lighting system 400, and a first sidewall 428 extending upward from the base 424 towards a top surface 430 of the strip lighting system 400, and a second sidewall 432 being spaced apart across the base 424 from the first sidewall 428 and extending upward from the base 424 towards the top surface 430 of the strip lighting system 400, the strip lighting system 400 further including the divider 434 in the elongated internal space 416 extending between the first and second sidewalls 428, 432 for separating the elongated internal space 416 into the upper section 436 of the strip lighting system 400 and the lower section 438 of the strip lighting system 400 located between the base 424 and the upper section 436. In the another example 400 of the strip lighting system, the plurality of light emitting diodes (LEDs) 408, 409, 410, 411 may be mutually spaced apart and mounted on the circuit board 406 and may be positioned to emit light emissions 440 toward the top surface 430 of the strip lighting system 400. In the another example 400 of the strip lighting system, the wiring 412 and the circuit board 406 are in mutual electrical communication. Further in the another example 400 of the strip lighting system, a portion 442 of the wiring 412 may be located in the lower section 438 of the strip lighting system 400, and another portion 444 of the wiring 412 may be located in the upper section 436 of the strip lighting system 400, and a further portion 446 of the wiring 412 may be located in the lower section 438 of the strip lighting system 400 and may form an electrical conductor 448 through the external port 450 in the wall 404. Additionally in the another example 400 of the strip lighting system, the elastomeric strain-relief section 414 is located at the wall 404 in the lower section 438 of the strip lighting system 400 for reinforcing the external port 450 in the wall 404; and may encapsulate the electrical conductor 448 at the wall 404 in a fixed position.

In some examples 400 of the strip lighting system, the another portion 444 of the wiring 412 in the upper section 436 of the strip lighting system 400 may span a portion of the distance 418 between the two distal ends 420, 422 of the wall 404. In further examples 400 of the strip lighting system, the another portion 444 of the wiring 412 in the upper section 436 of the strip lighting system may substantially span the distance 418 between the two distal ends 420, 422 of the wall 404. In additional examples 400 of the strip lighting system, the portion 442 of the wiring 412 and the another portion 444 of the wiring 412 may pass in mutual electrical communication outside of the circuit board 406 between the upper section 436 of the elongated internal space 416 and the lower section 438 of the elongated internal space 416 via one or more apertures 452 formed in the divider 434. In other examples 400 of the strip lighting system, the further portion 446 of the wiring 412 may include a connector component (not shown) passing through the external port 450 in the wall 404. In some examples 400 of the strip lighting system, the circuit board 406 may be configured for direct electrical connection of the electrical conductor 448 to a high voltage power source (not shown). In further examples 400 of the strip lighting system, the elastomeric strain-relief section 414 may include a silicone or a rubber. In additional examples 400 of the strip lighting system, the tray 402 may be an elastomeric tray 402 and the divider 434 may be an elastomeric divider 434. In other examples 400 of the strip lighting system, the elastomeric tray 402 and the elastomeric divider 434 may each include a silicone or a rubber. In some examples, the strip lighting system 400 may further include a metal reinforcement (not shown) surrounding the external port 450 in the wall 404.

In some embodiments, more than one wire may be assembled in a cable. In some embodiments, the cable may extend from the AC power source to or proximate the inlet port. For example, the cable may extend from the AC power source to an electrical connector component that extends through the inlet port. In some embodiments, cable may not be present within the tray so that the wires are no longer assembled with one another (within a cable) when they are in tray. In such embodiments, the wires may separately extend within various sections with the tray and may be separately connected to separate portions of the circuit board.

In some embodiments, potting material (e.g., silicone) and/or RTV glue may be used to encapsulate wiring and/or other components used in connection with the wiring (e.g., electrical connector component(s)).

It should be understood that other wiring configurations may be used. For example, wiring may enter the tray through an inlet port formed in the lower section and may extend within the lower section until passing through one or more aperture(s) in the divider to enter the upper section where the wiring is connected (e.g., by soldering) to bond pad(s) on the circuit board. In another embodiment, some of the wiring may enter the tray through an inlet port formed in the upper section where that wiring is connected (e.g., by soldering) to bond pad(s) on the circuit board and other wiring may enter the tray through an inlet port formed in the upper section and may pass through one or more aperture(s) in the divider to enter the lower section where such wiring may extend along (at least a portion of) the length of the lighting system and may pass through one or more additional aperture(s) formed in the divider to return to the upper section of the tray where the wiring is connected (e.g., by soldering) to bond pad(s) on the circuit board.

In some embodiments, wiring may be connected within the tray by electrical clips.

In some embodiments, the strip lighting system may include more than one lighting strip segment that are connected to one another to form a longer strip. For example, in som embodiments, a strip lighting system includes a plurality of strip lighting segments **400*a***. In such embodiments, the segments may be connected to one another using suitable mechanical and/or electrical connection mechanisms. For example, respective segments may be configured to have corresponding engagement features (e.g., on trays) which can cooperate to mechanically connect adjacent segments. Segments may additionally, or separately, be connected using an electrical connector assembly, for example, that joins wiring from one segment to wiring of an adjacent segment.

In some embodiments, the strip lighting system may be designed to be flexible so that the system may be bent during use.

It should be appreciated that the embodiments described herein may be implemented in any of numerous ways. Examples of specific implementations are provided herein for illustrative purposes only. It should be appreciated that these embodiments and the features/capabilities provided may be used individually, all together, or in any combination of two or more, as aspects of the technology described herein are not limited in this respect.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

The terms "approximately," "about," and "substantially" may be used to mean within ±20% of a target value in some embodiments, within ±10% of a target value in some embodiments, within ±5% of a target value in some embodiments, and yet within ±2% of a target value in some embodiments. The terms "approximately," "about," and "substantially" may include the target value.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Having described above several aspects of at least one embodiment, it is to be appreciated various alterations, modifications, and improvements will readily occur to those skilled in the art. Such alterations, modifications, and improvements are intended to be object of this disclosure. Accordingly, the foregoing description and drawings are by way of example only.

What is claimed is:

1. A strip lighting system, comprising:

a tray defining an elongated internal space, the tray including a divider separating the elongated internal space into an upper section and a lower section;

a circuit board disposed in the upper section of the elongated internal space;

one or more light emitting diodes (LEDs) mounted to the circuit board;

wiring being electrically connected to the circuit board and disposed at least in part within the upper and lower sections of the elongated internal space; and an external port of the strip lighting system located in the lower section of the elongated internal space, the wiring passing into the strip lighting system through the external port, the external port being reinforced by an elastomeric strain-relief section; wherein the strip lighting system is configured to be driven directly or indirectly by an alternating current (AC) power source; and wherein the wiring passes outside of the circuit board between the upper section of the elongated internal space and the lower section of the elongated internal space via one or more apertures formed in the divider.

2. The strip lighting system of claim 1, further including one or more lenses disposed over the one or more LEDs.

3. The strip lighting system of claim 1, further including a connector component electrically connected to the wiring.

4. The strip lighting system of claim 3, wherein at least a portion of the connector component is not encapsulated by the elastomer.

5. The strip lighting system of claim 1, wherein the elastomer includes silicone material.

6. The strip lighting system of claim 1, wherein the divider includes a base upon which the circuit board is positioned.

7. The strip lighting system of claim 1, including more than one strip lighting segment joined together.

8. The strip lighting system of claim 1, wherein the strip lighting system is directly driven by the AC power source.

9. The strip lighting system of claim 1, wherein the AC power source includes a wall power socket.

10. The strip lighting system of claim 1, wherein the strip lighting system is indirectly driven by the AC power source.

11. The strip lighting system of claim 10, wherein the strip lighting system is driven by an LED driver electrically connected to the AC power source.

12. The strip lighting system of claim 11, wherein the LED driver is configured to convert the AC power to DC power.

13. The strip lighting system of claim 11, wherein the LED driver is a rectifier power supply unit or a high voltage switched mode power supply (SMPS) unit.

14. The strip lighting system of claim 1, wherein the tray defines the elongated internal space as spanning a distance between two distal ends of a wall, and wherein a portion of the wiring spans a portion of the distance between the two distal ends of the wall within the lower section of the elongated internal space.

15. The strip lighting system of claim 1, wherein the tray is formed by a wall defining the elongated internal space as spanning a distance between two distal ends of the wall, the wall including a base forming a bottom surface of the strip lighting system, and including a first sidewall extending upward from the base towards a top surface of the strip lighting system, and including a second sidewall being spaced apart across the base from the first sidewall and extending upward from the base towards the top surface of the strip lighting system.

16. The strip lighting system of claim 1, wherein the strip lighting system further includes a metal reinforcement surrounding the external port.

* * * * *